US005154245A

United States Patent [19]

Waldenström et al.

[11] Patent Number: 5,154,245

[45] Date of Patent: Oct. 13, 1992

[54] DIAMOND ROCK TOOLS FOR PERCUSSIVE AND ROTARY CRUSHING ROCK DRILLING

[75] Inventors: Mats G. Waldenström, Bromma; Udo K. R. Fischer, Vallingby; Lars H. Hillert, Nacka, all of Sweden; Mahlon D. Dennis, Kingwood, Tex.

[73] Assignee: Sandvik AB, Sandviken, Sweden

[21] Appl. No.: 511,096

[22] Filed: Apr. 19, 1990

[51] Int. Cl.[5] ..... E21B 10/46

[52] U.S. Cl. ..... 175/420.2; 175/428

[58] Field of Search ..... 175/329, 409, 410; 76/108 A

[56] References Cited

U.S. PATENT DOCUMENTS

| | | | |
|---|---|---|---|
| 2,941,248 | 6/1960 | Hall | 18/16.5 |
| 3,141,746 | 7/1964 | De Lai | 51/307 |
| 3,757,878 | 9/1973 | Wilder et al. | 175/329 |
| 3,757,879 | 9/1973 | Wilder et al. | 175/329 |
| 4,274,840 | 6/1981 | Housman | 175/329 X |
| 4,531,595 | 7/1985 | Housman | 175/329 |
| 4,592,433 | 6/1986 | Dennis | 175/329 |
| 4,593,776 | 6/1986 | Salesky et al. | 175/375 |
| 4,707,384 | 11/1987 | Schachner et al. | 427/240 |
| 4,731,296 | 3/1988 | Kikuchi et al. | 428/552 |
| 4,743,515 | 5/1988 | Fischer et al. | 428/698 |
| 4,751,972 | 6/1988 | Jones et al. | 175/329 |
| 4,764,434 | 8/1988 | Aronsson et al. | 428/565 |
| 4,766,040 | 8/1988 | Hillert et al. | 428/552 |
| 4,784,023 | 11/1988 | Dennis | 76/108 |
| 4,811,801 | 3/1989 | Salesky et al. | 175/329 |
| 4,819,516 | 4/1989 | Dennis | 76/101 |
| 4,820,482 | 4/1989 | Fischer et al. | 419/15 |
| 4,843,039 | 6/1989 | Akesson et al. | 501/87 |
| 4,858,707 | 8/1989 | Jones et al. | 175/329 |
| 4,871,377 | 10/0389 | Frushour | 51/309 |
| 4,889,017 | 12/1989 | Fuller et al. | 76/108 A |
| 4,972,637 | 11/1990 | Dyer | 51/295 |

FOREIGN PATENT DOCUMENTS

| | | |
|---|---|---|
| 0029535 | 6/1981 | European Pat. Off. . |
| 0356097 | 2/1990 | European Pat. Off. . |
| 2138864 | 10/1984 | United Kingdom . |

*Primary Examiner*—William P. Neuder

*Attorney, Agent, or Firm*—Burns, Doane, Swecker & Mathis

[57] ABSTRACT

The present invention relates to a rock bit button of cemented carbide for percussive or rotary crushing rock drilling. The button is provided with one or more bodies of polycrystalline diamond in the surface produced at high pressure and high temperature in the diamond stable area. Each diamond body is completely surrounded by cemented carbide except the top surface.

25 Claims, 4 Drawing Sheets

FIG. 1
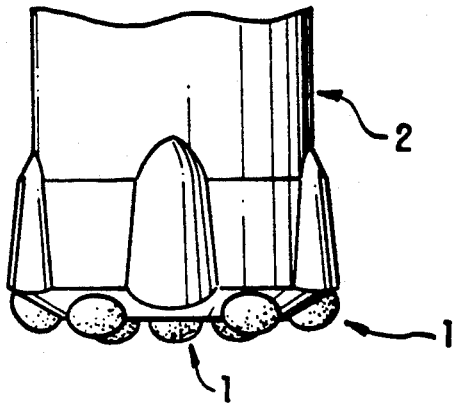
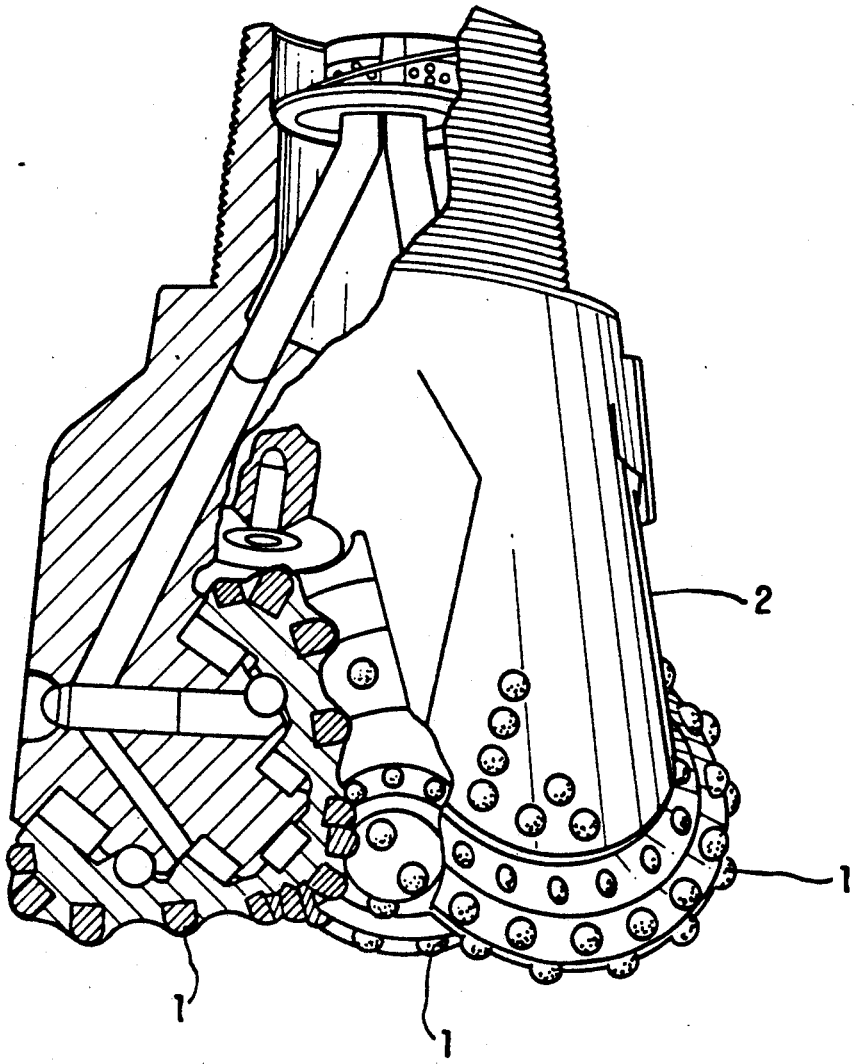
FIG. 2

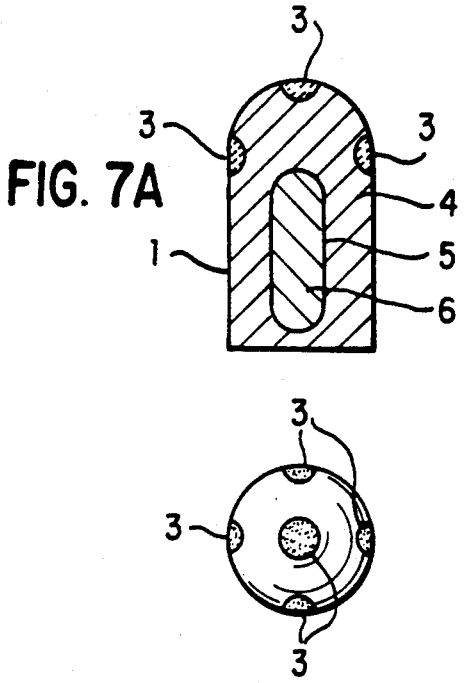
FIG. 7A
FIG. 7B
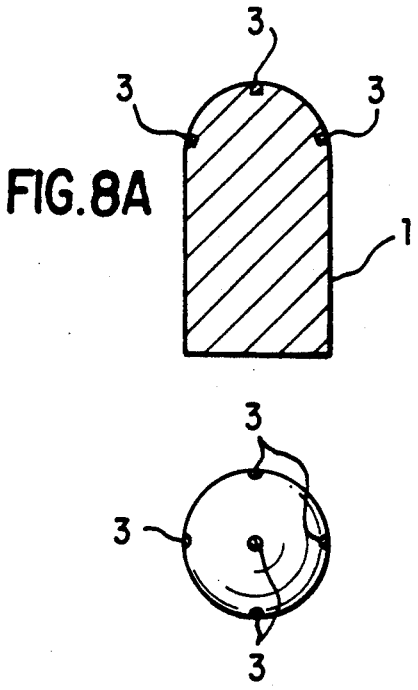
FIG. 8A
FIG. 8B
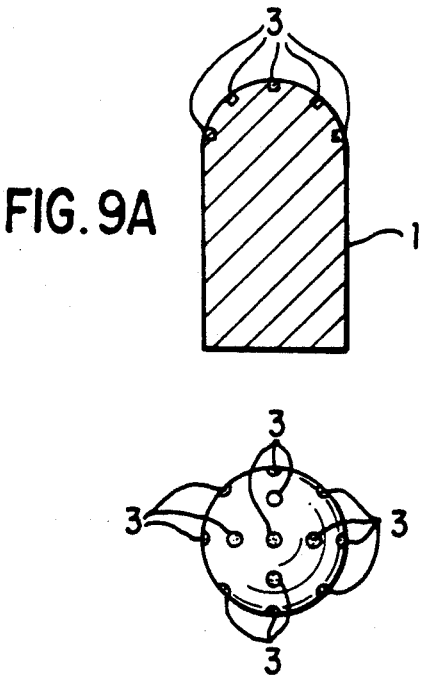
FIG. 9A
FIG. 9B
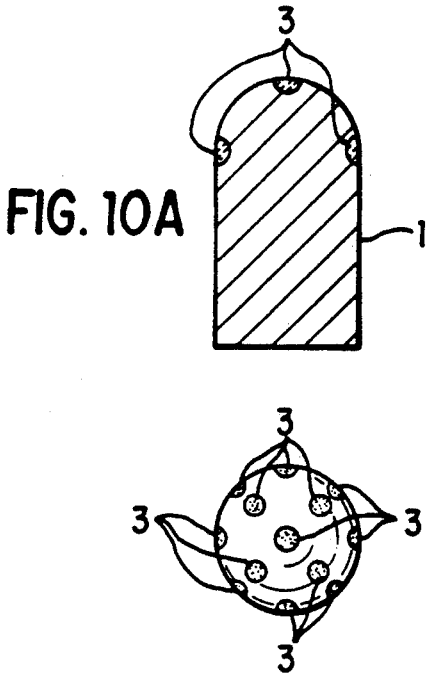
FIG. 10A
FIG. 10B

DIAMOND ROCK TOOLS FOR PERCUSSIVE AND ROTARY CRUSHING ROCK DRILLING

FIELD OF THE INVENTION

The present invention concerns the field of rock bits and buttons therefor. More particularly the invention relates to rock bit buttons for percussive and rotary crushing rock drilling. The buttons comprise cemented carbide provided with one or more bodies of polycrystalline diamond in the surface.

BACKGROUND OF THE INVENTION

There are three main groups of rock drilling methods: percussive, rotary crushing and rotary cutting rock drilling. In percussive and rotary crushing rock drilling the bit buttons are working as rock crushing tools as opposed to rotary cutting rock drilling, where the inserts work rather as cutting elements. A rock drill bit generally consists of a body of steel which is provided with a number of inserts comprising cemented carbide. Many different types of such rock bits exist having different shapes of the body of steel and of the inserts of cemented carbide as well as different numbers and grades of the inserts.

For percussive and rotary crushing rock drilling the inserts generally have a rounded shape, often of a cylinder with a rounded top surface generally referred to as a button. For rotary cutting rock drilling the inserts are provided with a sharp edge acting as a cutter.

There already exists a number of different high pressure-high temperature sintered cutters provided with polycrystalline diamond layers. These high wear resistant cutter tools are mainly used for oil drilling.

The technique when producing such polycrystalline diamond tools using high pressure-high temperature (HP/HT) has been described in a number of patents, e.g.:

U.S. Pat. No. 2,941,248: "High temperature high pressure apparatus".

U.S. Pat. No. 3,141,746: "Diamond compact abrasive".

High pressure bonded body having more than 50 vol % diamond and a metal binder: Co,Ni,Ti,Cr,Mn,Ta etc.

These patents disclose the use of a pressure and a temperature where diamond is the stable phase.

In some later patents: e.g. U.S. Pat. Nos. 4,764,434 and 4,766,040 high pressure-high temperature sintered polycrystalline diamond tools are described. In the first patent the diamond layer is bonded to a support body having a complex, non-plane geometry by means of a thin layer of a refractory material applied by PVD or CVD technique.

In the second patent temperature resistant abrasive polycrystalline diamond bodies are described having different additions of binder metals at different distances from the working surface.

A recent development in this field is the use of one or more continuous layers of polycrystalline diamond on the top surface of the cemented carbide button.

U.S. Pat. No. 4,811,801 discloses rock bit buttons including such a polycrystalline diamond surface on top of the cemented carbide buttons having a Young's modulus of elasticity between 80 and $102\times10^6$ p.s.i., a coefficient of thermal expansion between 2,5 and $3{,}4\times10^{-6}$° C.$^{-1}$, a hardness between 88,1 and 91,1 HRA and a coercivity between 85 and 160 Oe. Another development is disclosed in U.S. Pat. No. 4;592,433 including a cutting blank for use on a drill bit comprising a substrate of a hard material having a cutting surface with strips of polycrystalline diamond dispersed in grooves, arranged in various patterns.

U.S. Pat. No. 4,784,023 discloses a cutting element comprising a stud and a composite bonded thereto.

The composite comprises a substrate formed of cemented carbide and a diamond layer bonded to the substrate.

The interface between the diamond layer and the substrate is defined by alternating ridges of diamond and cemented carbide which are mutually interlocked. The top surface of the diamond body is continuous and covering the whole insert. The sides of the diamond body are not in direct contact with any cemented carbide.

U.S. Pat. No. 4,819,516 discloses a cutting element with a V-shaped diamond cutting face. The cutting element is formed from a single circular cutting blank by cutting the blank into segments, joining two identical ones of the segments and truncating the joined segments. Also in this case the surface of the diamond body is continuous and the sides are not in direct contact with any cemented carbide.

Yet another development in this field is the use of cemented carbide bodies having different structures in different distances from the surface.

U.S. Pat. No. 4,743,515 discloses rock bit buttons of cemented carbide containing eta-phase surrounded by a surface zone of cemented carbide free of eta-phase and having a low content of cobalt in the surface and a higher content of cobalt next to the eta-phase zone.

U.S. Pat. No. 4,820,482 discloses rock bit buttons of cemented carbide having a content of binder phase in the surface that is lower and in the center higher than the nominal content. In the center there is a zone having a uniform content of binder phase. The tungsten carbide grain size is uniform throughout the body.

OBJECT OF THE INVENTION

The object of the invention is to provide a rock bit button of cemented carbide with one or more bodies of polycrystalline diamond in the surface with high and uniform compression of the diamond body (bodies) by sintering at high pressure and high temperature in the diamond stable area. It is a further object of the invention to make it possible to maximize the effect of diamond on the resistance to cracking and chipping and to wear as well as to minimize the consumption of the expensive diamond feed stock.

It is still further an object of the invention to obtain a button of which the machining operations can be made at a low cost.

SUMMARY OF THE INVENTION

According to the present invention there is provided a rock bit button for percussive and rotary crushing rock drilling comprising a body of cemented carbide provided with one or more bodies of polycrystalline diamond in the surface and produced at high pressure and high temperature.

Each diamond body is completely surrounded by cemented carbide except the top surface.

The rock bit button above can be adapted to different types of rocks by changing the material properties and geometries of the cemented carbide and/or the polycrystalline diamond, especially hardness, elasticity and thermal expansion, giving different wear resistance and impact strength of the button bits.

Percussive rock drilling tests using buttons of the type described in U.S. Pat. No. 4,811,801 with continuous polycrystalline layers on the surface of cemented carbide revealed a tendency of cracking and chipping off part of the diamond layer.

When using one or more discrete bodies of polycrystalline diamond according to the invention it was surprisingly found that the cracking and chipping tendency considerably decreased. At the same time the wear resistance of the buttons was surprisingly high.

The explanation for these effects, the increase of the resistance against cracking and chipping and against wearing, might be a favourable stress pattern caused by the difference between the thermal expansion of the diamond body and the cemented carbide body, giving the diamond a high and uniform compressive prestress.

A further improvement of the behaviour of the buttons was revealed when using a cemented carbide body having a multi-structure according to U.S. Pat. No. 4,743,515: FIG. 7, it was surprisingly found that the cracking tendency of the cemented carbide in the bottom of the bodies of polycrystalline diamond considerably decreased compared to the corresponding geometry and composition without the multi-structure carbide. Also the wear resistance of the buttons was improved at the same time.

BRIEF DESCRIPTION OF THE DRAWINGS

1=cemented carbide button
2=steel body
3=diamond body
4=cemented carbide: Co poor zone
5=cemented carbide: Co rich zone
6=cemented carbide: eta-phase rich zone FIG. 1 shows a standard bit for percussive rock drilling provided with cemented carbide buttons.

FIG. 2 shows a standard bit for rotary crushing rock drilling provided with cemented carbide buttons.

FIGS. 7A and 7B show a button of cemented carbide provided with 5 bodies of polycrystalline diamond in the surface. The core of the cemented carbide body is containing eta-phase surrounded by a surface zone of cemented carbide free of eta-phase.

FIGS. 8A–14A and 8B–14B show various embodiments of bit buttons according to the invention.

Figure 3A:
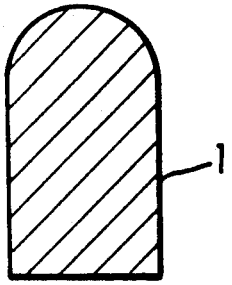
FIGS. 3A and 3B show a standard cemented carbide button without diamond.

DETAILED DESCRIPTION OF THE INVENTION.

The rock bit button according to the present invention is provided with one or more polycrystalline diamond bodies in the surface. The diamond bodies can be of various shapes such as spherical, oval, conical or cylindrical of which shapes with a rounded bottom are preferred. Other more asymmetrical shapes could be used such as rectangular or a rectangular cross pattern like an X or + sign from a top view. Of course, to reduce stress concentration points and reduce cracking, all 90° angles on edges and corners would be well rounded or chamferred. Other shapes such as pyramids, square pyramids or chevrons may be excellent cutter points as well.

For special applications you may dispose the diamond on the convex carbide surface in rings or spirals.

Combinations of different shapes and sizes in the same button can also be used.

Independent of the shape the surface length of the diamond body shall be more than 1 mm, preferably 2–10 mm and the height more than 0.5 mm, preferably 1–5 mm. The size of the body of polycrystalline diamond is depending on the size of the button and the number of diamond bodies. Small bodies are less sensitive to cracking and chipping than larger bodies. The rock bit button shall have a diameter of 5–30 mm preferably 7–15 mm. Other shapes than cylindrical are also possible such as chisel shaped, spherical, oval or conical. Other more asymmetric shapes could also be used such as rectangular, pyramids or square pyramids.

The number of diamond bodies shall be at least one, preferably less than 15. One preferred embodiment is just one concentric diamond body on top of the button with a surface length of 10–50%, preferably 15–30%, of the diameter of the cemented carbide button independent of the shape of the diamond body. Another preferred embodiment is 2–5 diamond bodies on top of the button.

The distance between the diamond bodies depends on the size of the button and the number of diamond bodies 10–50% preferably 15–30%, of the exposed button area shall be covered by diamond bodies.

Preferably the separation distance between adjacent bodies shall be at least 1 mm, preferably 1–3 mm.

The diamond bodies can be located symmetrically or asymmetrically around the button. The diamond bodies are preferably closer to each other on areas more exposed to wear, depending on where the button is placed in the drill bit.

The polycrystalline diamond body shall also be adapted to the type of rock and drilling method by varying the grain size of the diamond and the amount of binder metal. The grain size of the diamond shall be 3–500 micrometer, preferably 35–150 micrometer. The diamond may be of only one nominal grain size or consist of a mixture of sizes, such as 80 w/o of 40 micrometer and 20 w/o of 10 micrometer. Different types of binder metals can be used such as Co, Ni, Mo, Ti, Zr, W, Si, Ta, Fe, Cr, Al, Mg, Cu, etc. or alloys between them. The amount of binder metal shall be 1–40 vol. %, preferably 3–20 vol. %.

In addition other hard materials, preferably less than 50 vol. %, can be added such as: $B_4C$, $TiB_2$, SiC, ZrC, WC, TiN, ZrB, ZrN, TiC, (Ta, Nb) C, Cr-carbides, AlN, $Si_3N_4$, $AlB_2$, etc. as well as whiskers of $B_4C$, SiC, TiN, $Si_3N_4$, etc. (See U.S. Pat. No. 4,766,040, incorporated herein by reference). The bodies of polycrystalline diamond may have different levels of binder metal at different distances from the working surface according to U.S. Pat. No. 4,766,040. The cemented carbide grade shall be chosen with respect to type of rock and drilling methods. It is important to chose a grade which has a suitable wear resistance compared to that of the polycrystalline diamond body. The binder phase content shall be 3–35 weight %, preferably 5–12 weight % for percussive and preferably 5–25 weight % for rotary crushing rock drilling buttons and the grain size of the cemented carbide at least 1 micrometer, preferably 2–6 micrometer.

In a preferred embodiment the cemented carbide body shall have a core containing eta-phase. The size of this core shall be 10–95%, preferably 30–65% of the total amount of cemented carbide in the body.

The core should contain at least 2% by volume, preferably at least 10% by volume of eta-phase but at most 60% by volume, preferably at the most 35% by volume.

In the zone free of eta-phase the content of binder phase, i.e. in general the content of cobalt, shall in the surface be 0,1–0,9, preferably 0,2–0,7 of the nominal content of binder phase. It shall gradually increase up to at least 1,2, preferably 1,4–2,5 of the nominal content of binder phase at the boundery close to the eta-phase core. The width of the zone poor of binder phase shall be 0,2–0,8, preferably 0,3–0,7 of the width of the zone free of eta-phase, but at least 0.4 mm and preferably at least 0.8 mm in width.

The bodies of polycrystalline diamond may extend a shorter or longer distance into the cemented carbide body and the diamond bodies could be in contact with all three described zones, preferably in contact only with the cobalt poor zone.

In one embodiment the diamond body consists of one big well crystallized grain surrounded by finer grains. In another embodiment the diamond body consists of a presintered body in which the binder metal has been extracted by acids. In yet another embodiment the diamond body is prefabricated by a CVD- or PVD-method.

The different embodiments mentioned above are made by using HP/HT technique. In the case of prefabricated diamond bodies the diamond can be attached to the cemented carbide by other methods, such as brazing.

The cemented carbide buttons are manufactured by powder metallurgical methods. The holes for the diamond bodies are preferably made before sintering either in a separate operation or by compacting in a specially designed tool. Particularly in the case of the multi-structure embodiment the holes may be made after the sintering of the cemented carbide.

After sintering the holes are filled with diamond powder, and binder metal and other ingredients, sealed and sintered at high pressure, more than 3.5 GPa, preferably at 6–7 GPa, and at a temperature of more than 1100° C., preferably 1700° C. for 1–30 minutes, preferably about 3 minutes. The content of binder metal in the diamond body may be controlled either by coating the button before filling with diamond with a thin layer of e.g. TiN by CVD- or PVD-methods or by using thin foils such as Mo as disclosed in U.S. Pat. No. 4,764,434, incorporated herein by reference.

After high-pressure sintering the button is blasted and ground to final shape and dimension.

EXAMPLE 1

Percussive Rock Drilling

In a test in a quartzite quarry the penetration rate and the life length of the bits with buttons according to the invention were compared to bits with buttons of conventional cemented carbide and to bits with PDC buttons having a continuous top layer of polycrystalline diamond. All buttons had the same composition.

The drill bit having 6 buttons on the periphery was a bit with a special and strong construction for use in very hard rocks. (FIG. 1).

Figure 3B:
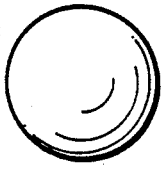

Bit A. (FIG. 3) All buttons on the periphery consisted of cemented carbide with 6 weight % cobalt and 94 weight % WC having a grain size of 2 micrometer. The hardness was 1450 HV3.

Figure 4A:
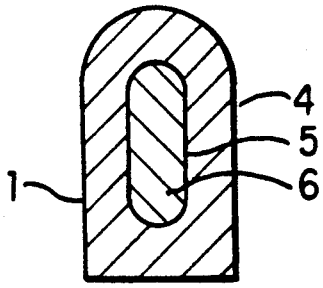
FIGS. 4A and 4B show a button where the cemented carbide is containing eta-phase surrounded by a surface zone of cemented carbide free of eta-phase.
Figure 4B:
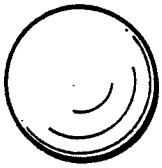

Bit B. (FIG. 4) All buttons on the periphery consisted of cemented carbide having a core that contained eta-phase surrounded by a surface zone of cemented carbide free of eta-phase having a low content of cobalt (3 weight %) at the surface and a higher content of cobalt (11 weight %) next to the eta-phase zone.

Figure 5A:
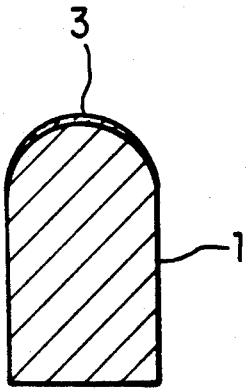
FIGS. 5A and 5B show a button of cemented carbide with a top layer of polycrystalline diamond.
Figure 5B:
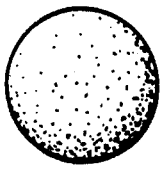

Bit C. (FIG. 5) All buttons on the periphery consisted of cemented carbide having a continuous 0.7 mm thick top layer of polycrystalline diamond.

Bit D. (FIG. 6) All buttons on the periphery consisted of cemented carbide having 5 bodies of polycrystalline diamond completely surrounded by cemented carbide except the top surface according to the invention.

Bit E. (FIG. 7) All buttons on the periphery consisted of cemented carbide having 5 bodies of polycrystalline diamond completely surrounded by cemented carbide except the top surface according to the invention.

All these buttons consisted of cemented carbide having a core that contained eta-phase surrounded by a surface zone of cemented carbide free of eta-phase having a low content of cobalt (3 weight %) at the surface and a higher content of cobalt (11 weight %) next to the eta-phase zone.

The holes in the button were made before the sintering of the cemented carbide. The diamond bodies were symmetrically placed according to FIG. 6. They had a diameter of 2,5 mm and a depth of 2 mm and had a spherical bottom.

The test data were:

Application: Bench drilling in very abrasive quarzite
Rock drilling: COP 1036
Drilling rigg: ROC 712
Impact pressure: 190 bar
Stroke position: 3
Feed pressure: 70–80 bar
Rotation pressure: 60 bar
Rotation: 120 r.p.m.
Air pressure: 4,5 bar
Hole depth: 6–18 m

| | RESULTS | | | |
|---|---|---|---|---|
| Type of button | No of bits | Ave life m | Average penetration m per min. | Chipping tendency |
| A (FIG. 3) | 6 | 111 | 1,1 | no |
| B (FIG. 4) | 6 | 180 | 1,2 | no |
| C (FIG. 5) | 6 | 280 | 1,3 | yes |
| D (FIG. 6) | 6 | 436 | 1,5 | no |
| E (FIG. 7) | 6 | 642 | 1,5 | no |

EXAMPLE 2

Rotary Crushing Rock Drilling

In an open-cut iron ore mine buttons according to the invention were tested in roller bits. The roller bits were of the type 12 ¼" CH with totally 261 spherical buttons. The diameter of the buttons was 14 mm on row 1–3 and 12 mm on row 4–6. (FIG. 2).

The same types of buttons: A, B, C, D and E were used in EXAMPLE 2 as in EXAMPLE 1 except that the cemented carbide had 10 w/o cobalt and 90 w/o WC and a hardness of 1200 HV3.

The performance in form of life time and penetration rate was measured. The drilling data were the following:

Drill rig: 4 pcs BE 60 R
Feed pressure: 60000–80000 lbs
RPM 60
Bench height 15 m
Hole depth 17 m
Rock formation Iron ore: very hard rock All test bits were of the same design: Sandvik 12¼' CH1 CH-bit, see end. All buttons had the same geometrical shape and size. The holes in the button were made before the sintering of the cemented carbide.

Figure 6A:
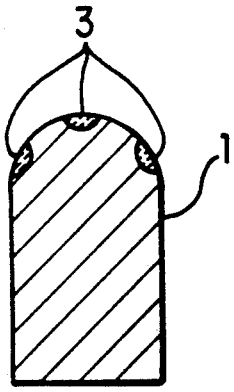
FIGS. 6A and 6B show a button of cemented carbide provided with 5 bodies of polycrystalline diamond in the surface.
Figure 6B:
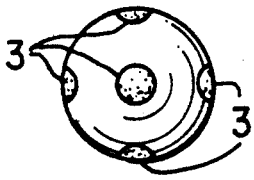
Figure 11A:
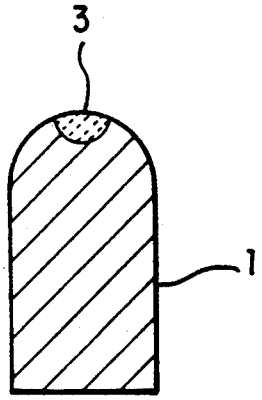
Figure 11B:
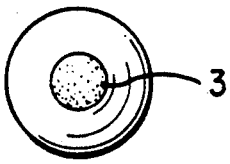
Figure 12A:
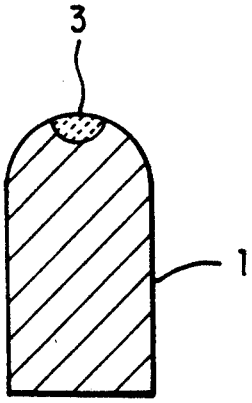
Figure 12B:
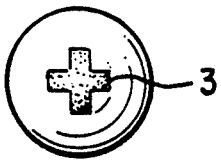
Figure 13A:
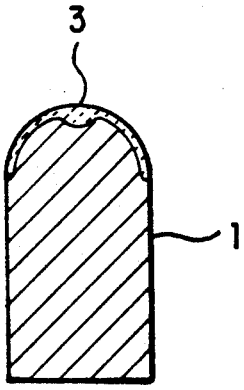
Figure 13B:
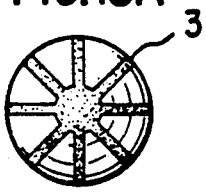
Figure 14A:
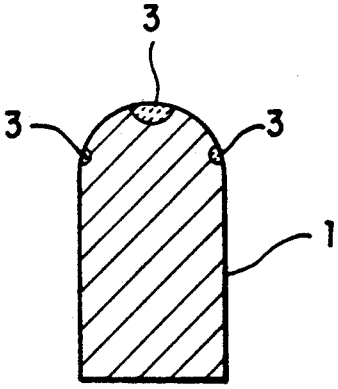
Figure 14B:
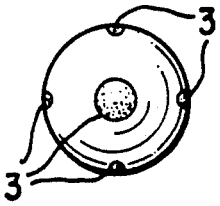

The diamond bodies were symmetrically placed according to FIG. 6.

RESULTS

| Type of button | No of bits | Aver. life m | Aver. penetration m/hr |
|---|---|---|---|
| A (FIG. 3) | 3 | 1400 | 15 |
| B (FIG. 4) | 3 | 1700 | 16 |
| C (FIG. 5) | 3 | 1900 | 17 |
| D (FIG. 6) | 3 | 2400 | 23 |
| E (FIG. 7) | 3 | 3000 | 23 |

We claim:

1. Cemented carbide rock bit button for percussive and rotary crushing rock drilling provided with at least one polycrystalline diamond body produced at high temperature and pressure, the diamond being compressively prestressed and being disposed within the cemented carbide button and surrounded by cemented carbide except for its top surface.

2. Rock bit button according to claim 1 provided with one concentric polycrystalline diamond body on top of the button with a surface length of 10–50% of the diameter of the button.

3. Rock bit button according to claim 1 provided with 2–5 polycrystalline bodies covering 10–50% of the surface area of the button.

4. Cemented carbide rock bit button of claim 1 for percussive and rotary crushing rock drilling provided with at least one polycrystalline diamond body in which the cemented carbide has an eta-phase containing core.

5. Rock bit button according to claim 1 in which each polycrystalline diamond body has a surface body that is greater than 1 mm.

6. Rock bit button according to claim 5 wherein each polycrystalline diamond body has a surface length of from 2–10 mm.

7. Rock bit button according to claim 1 wherein each polycrystalline diamond body has a height above the surface level greater than 0.5 mm.

8. Rock bit button according to claim 7 wherein the height of each said polycrystalline diamond body above the surface is from 1–5 mm.

9. Rock bit button according to claim 1 wherein said button is a diameter of from 5–30 mm.

10. Rock bit button according to claim 9 wherein the diameter of the rock bit button is from 7–15 mm.

11. Rock bit button according to claim 1 wherein said button contains less than 15 polycrystalline diamond bodies.

12. Rock bit button according to claim 11 wherein said button contains from 2–5 diamond bodies.

13. Rock bit button according to claim 1 wherein said button contains more than one polycrystalline diamond body and the separation distance between adjacent bodies is at least 1 mm.

14. Rock bit button according to claim 13 wherein the separation distance between adjacent polycrystalline diamond bodies is from 1–3 mm.

15. Rock bit button according to claim 12 wherein the diamond bodies are located symmetrically on the face of the button with respect to the longitudinal axis of the button.

16. Rock bit button according to claim 12 wherein the diamond bodies are located asymmetrically on the face of the button with respect to the longitudinal axis of the button.

17. Rock bit button according to claim 4 provided with one concentric polycrystalline diamond body on top of the button with a surface length of 10–50% of the diameter of the button.

18. Rock bit button according to claim 17 in which each polycrystalline diamond body has a surface body that is greater than 1 mm.

19. Rock bit button according to claim 18 wherein each polycrystalline diamond body has a height above the surface level greater than 0.5 mm.

20. Rock bit button according to claim 4 wherein said button is a diameter of from 5–30 mm.

21. Rock bit button according to claim 4 wherein said button contains less than 15 polycrystalline diamond bodies.

22. Rock bit button according to claim 4 wherein said button contains more than one polycrystalline diamond body and the separation distance between adjacent bodies is at least 1 mm.

23. Rock bit button according to claim 22 wherein the diamond bodies are located symmetrically on the face of the button with respect to the longitudinal axis of the button.

24. Rock bit button according to claim 22 wherein the diamond bodies are located asymmetrically on the face of the button with respect to the longitudinal axis of the button.

25. Rock bit button according to claim 4 wherein the diamond is compressively prestressed.

* * * * *